United States Patent [19]

Chang

[11] Patent Number: 5,046,518

[45] Date of Patent: Sep. 10, 1991

[54] FOLDING FRAME FOR USE IN UMBRELLA OR THE LIKE

[76] Inventor: Ching-Ming Chang, P.O. Box 10160, Taipei, Taiwan

[21] Appl. No.: 488,619

[22] Filed: Mar. 6, 1990

[51] Int. Cl.[5] ..... A45B 29/12

[52] U.S. Cl. ..... 135/37; 135/39

[58] Field of Search ..... 135/22-23, 135/24, 25 A, 37, 39

[56] References Cited

U.S. PATENT DOCUMENTS

| | | | |
|---|---|---|---|
| 833,724 | 10/1906 | Abbott | 135/20 R |
| 1,056,786 | 3/1913 | Freud | 135/23 |
| 1,236,299 | 8/1917 | Hart | 135/39 |
| 1,749,363 | 3/1930 | Venner | 135/37 |
| 1,843,961 | 2/1932 | Stone | 135/25 A |
| 2,047,711 | 7/1936 | Siers | 135/23 |
| 2,816,560 | 12/1957 | Wüster | 135/23 |
| 3,643,673 | 2/1972 | Weber | 135/20 |

FOREIGN PATENT DOCUMENTS

| | | | |
|---|---|---|---|
| 43130 | of 1930 | Fed. Rep. of Germany | 135/39 |
| 890121 | 9/1953 | Fed. Rep. of Germany | 135/20 |
| 1221405 | 7/1966 | Fed. Rep. of Germany | 135/22 |
| 447914 | 5/1936 | United Kingdom | 135/39 |

*Primary Examiner*—Henry E. Raduazo

[57] ABSTRACT

A folding frame for use in umbrella or the like includes a plurality of arcuate stretcher ribs each pivotally secured between a lower runner reciprocatively held on a central shaft of the umbrella and a top rib pivotally secured to an upper notch of the shaft so that when extending the ribs and an umbrella cloth secured to the top ribs for opening the umbrella, the arcuate stretcher ribs may resiliently retain the top ribs and the umbrella cloth without the aid of a spring catch for saving production cost and for simplifying a folding or extending operation of the umbrella.

2 Claims, 3 Drawing Sheets

FOLDING FRAME FOR USE IN UMBRELLA OR THE LIKE

BACKGROUND OF THE INVENTION

A conventional umbrella as shown in FIG. 1 includes a spring catch C for retaining a lower runner R of the stretcher rib S pivotally secured between the runner R and the top rib T which is pivotally secured to an upper notch N formed on a top portion of the central handle H, which however has the following drawbacks:

1. Once folding the umbrella ribs S,T, the spring catch C must be depressed to unlock the lower runner R. The catch C generally formed as a triangle may injure or cause pain for an umbrella user whose hand or fingers will be struck by the angled catch C.

2. The catch C may always include a spring plate inserted in the hollow handle H. For fixing the catch C on an umbrella handle H may increase the production cost of the umbrella.

3. During folding or extending operation of the umbrella, the catch C may increase the operation inconvenience.

The present inventor has found the drawbacks of the conventional umbrella and invented the present invention without providing the spring catch as above-mentioned.

SUMMARY OF THE INVENTION

The object of the present invention is to provide a folding frame for use in umbrella including a plurality of arcuate stretcher ribs each pivotally secured between a lower runner reciprocatively held on a central shaft of the umbrella and a top rib pivotally secured to an upper notch of the shaft so that when extending the ribs and an umbrella cloth secured to the top ribs for opening the umbrella, the arcuate stretcher ribs may resiliently retain the top ribs and the umbrella cloth without the aid of a spring catch for saving production cost and for simplifying a folding or extending operation of the umbrella.

DETAILED DESCRIPTION

Figure 1:
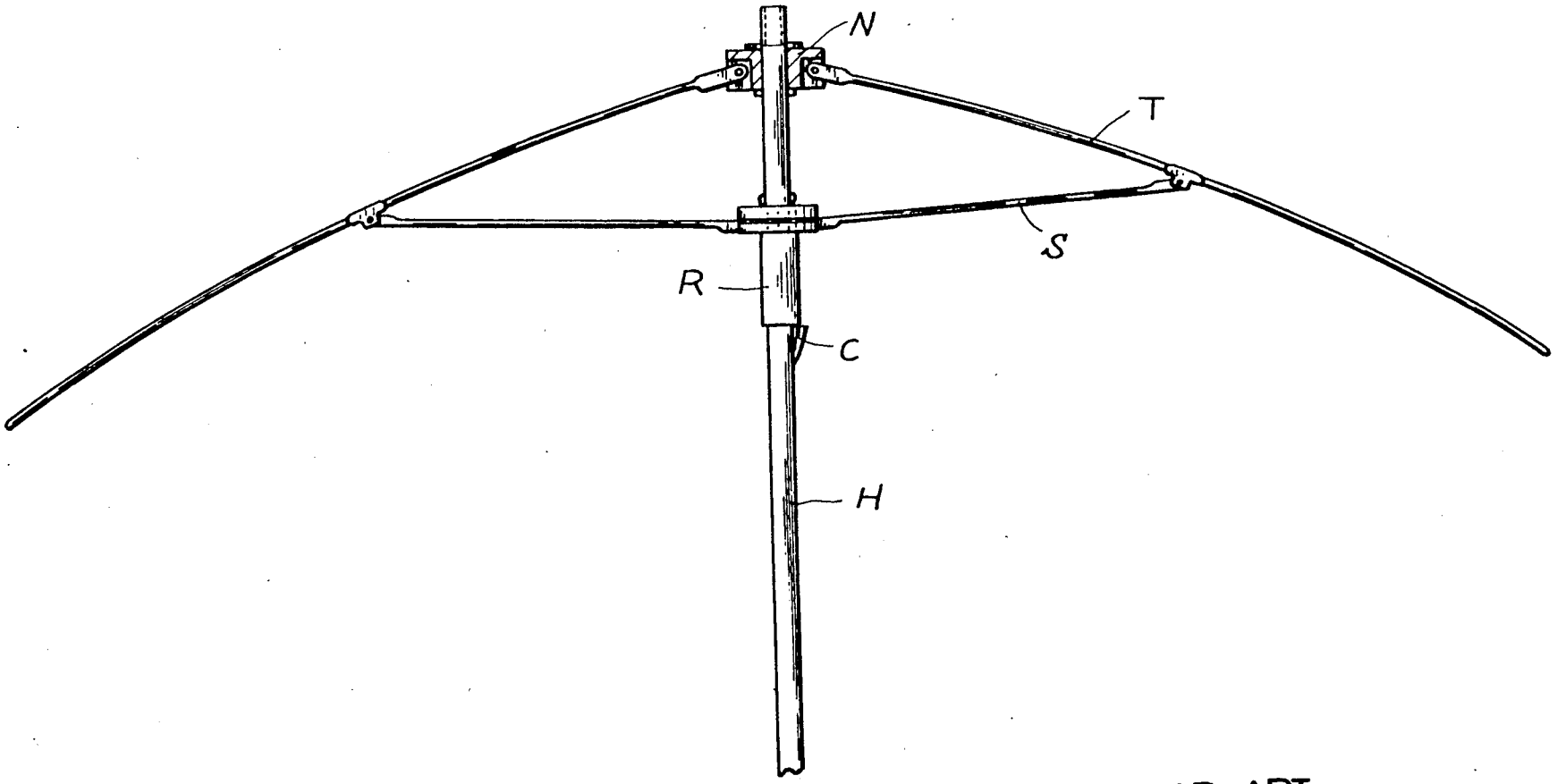
FIG. 1 PRIOR ART
FIG. 1 is an illustration showing a conventional umbrella.
Figure 2:
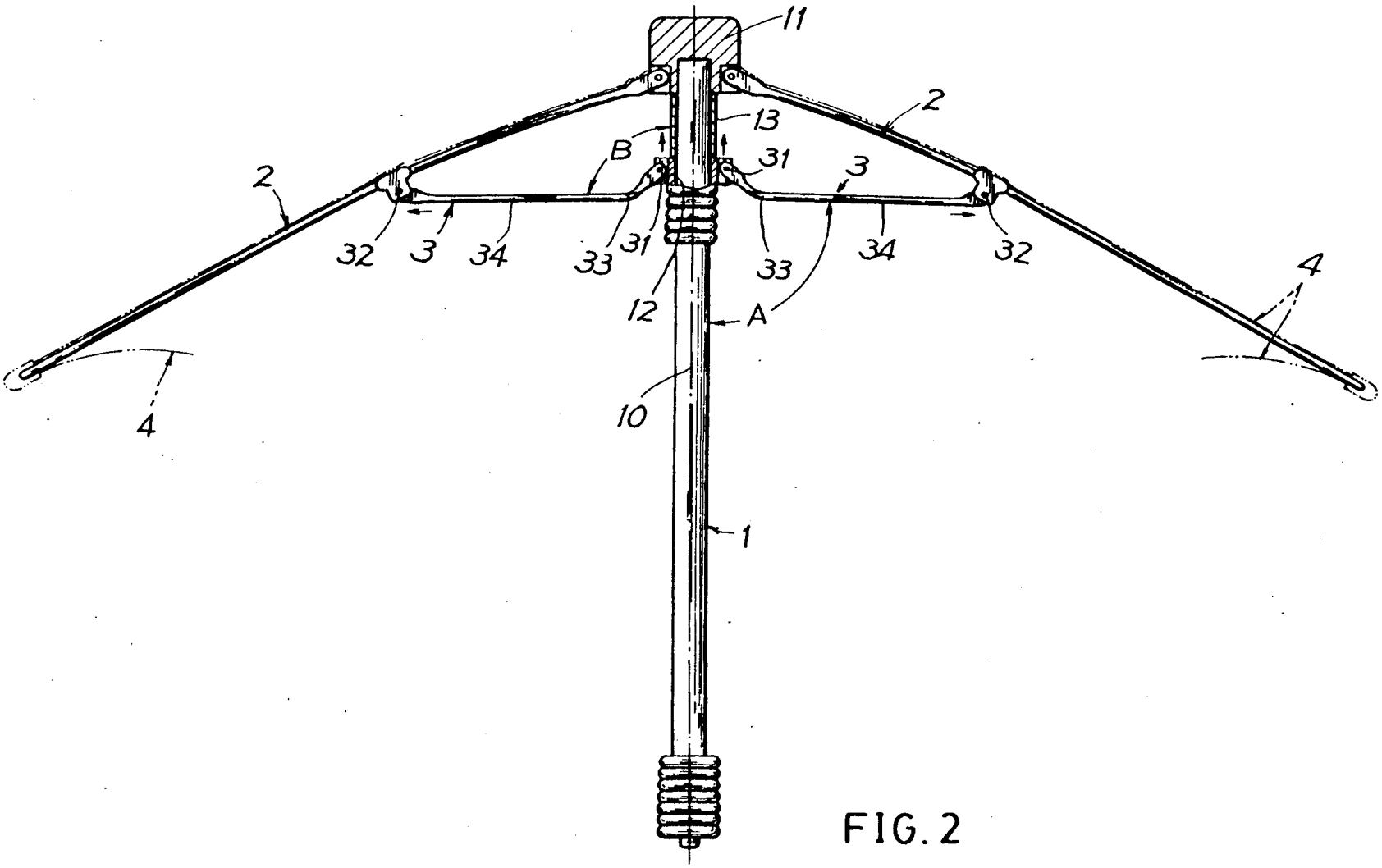
FIG. 2 is an illustration of the present invention when extended.
Figure 3:
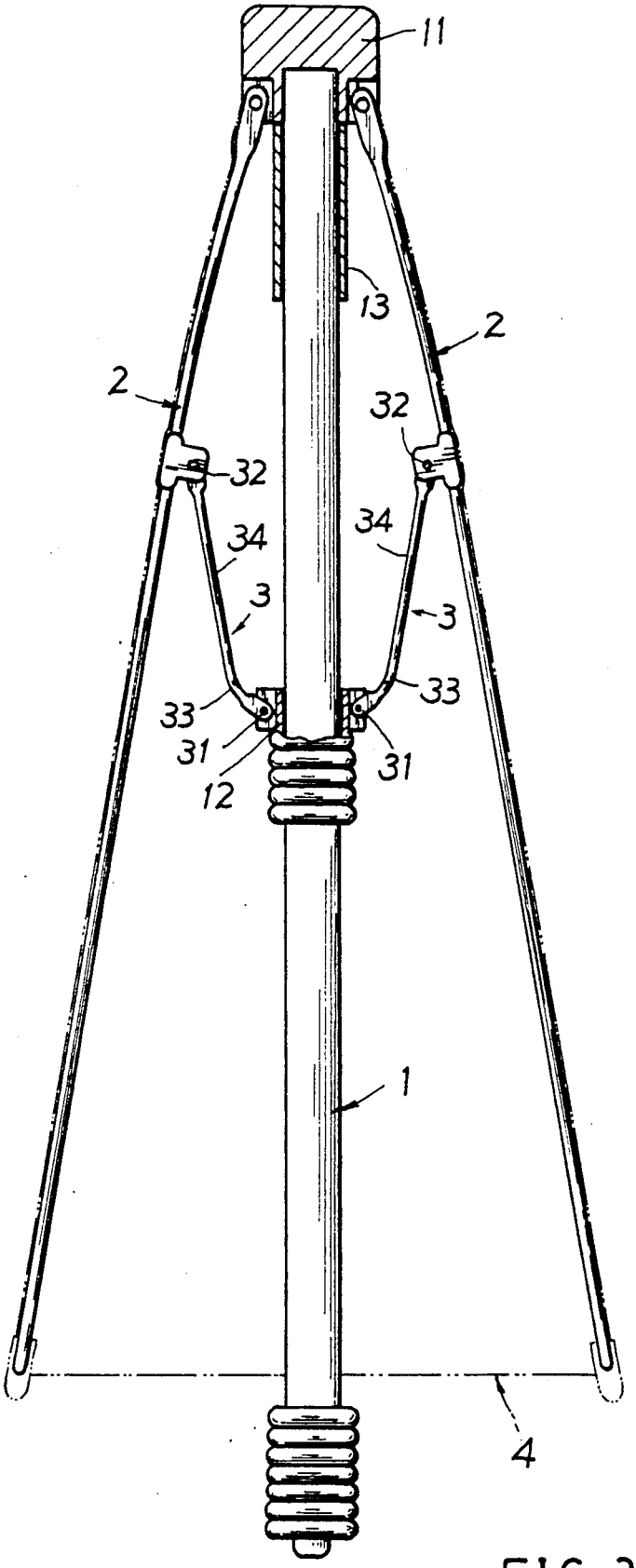
FIG. 3 is an illustration of the present invention when folded.

As shown in FIGS. 2 and 3, the present invention comprises: a central shaft 1 having an upper notch 11 formed on a top portion of the shaft 1 and a lower runner 12 reciprocatively held on the shaft 1 below the notch 11 and having a limiting sleeve 13 mounted on the shaft 11 between the notch 11 and the runner 12 when extending the umbrella; a plurality of top ribs 2 each top rib 2 having its inner end pivotally secured to the upper notch 11 and having an umbrella cloth 4 secured on the top ribs 2; and a plurality of arcuate stretcher ribs 3 each stretcher rib 3 pivotally secured between the lower runner 12 and the top rib 2.

Each arcuate stretcher rib 3 includes: an inner end portion 31 pivotally secured to the lower runner 12, an outer end portion 32 pivotally secured to each top rib 2, an arcuate portion 33 concavely formed on the rib 3 approximating to the inner end portion 31 of the rib 3, and a flat rib portion 34 formed on the rib 3 connected with the arcuate portion 33.

The flat rib portion 34 when extending the stretcher ribs 3, the top ribs and the umbrella cloth 4 for opening the umbrella is generally perpendicular to a longitudinal axis 10 of the central shaft 1 defining a lower angle A of less than ninety degrees between the flat portion 34 and the shaft 1 below the runner 12, and defining an upper angle B more than 90 degrees between the flat portion 34 and the sleeve 13 above the runner 12.

The arcuate stretcher rib 3 should have an elastic force urging the top rib 2 and the umbrella cloth 4 when raising the runner 12 to resiliently retain the stretcher rib 3 between the lower runner 12 and the top rib 2. Since angle A is less than 90 degrees and angle B is larger than 90 degrees, the elastic force exerting on the arcuate stretcher rib 3 will have its inner end portion 31 urging the runner 12 upwardly along the central shaft 1 to be limited by a lower periphery of the limiting sleeve 13 and have its outer end portion 32 urging the top rib 2 and umbrella cloth 4 upwardly and outwardly for tensioning and opening the umbrella cloth 4. The opened umbrella cloth 4 will also exert a surface tension as secured on the top ribs 2 when resiliently urged by the arcuate stretcher ribs 3. The tension of the stretcher ribs 3 and the tension of the cloth 4 will help stabilize an extended or opened umbrella for a shielding use as shown in FIG. 2.

When folding the present invention, the lower runner 12 is pulled downwardly along the central shaft 1, the elastic force of the stretcher ribs 3 will be released and the ribs 3,2 are lowered and retracted for folding the ribs and the cloth 4 of the umbrella.

The present invention has the following advantages superior to a conventional umbrella having a spring catch for supporting the runner:

1. The catch is eliminataed to save production cost and simplify the assembly of an umbrella.

2. The angled catch is omitted to prevent injury to a user's hand or fingers.

3. The folding or extending operation of the umbrella is easier by merely moving the runner 12 along the shaft 1 without disengaging or engaging a conventional catch resiliently mounted on the shaft.

The present invention may be used for a multiple-fold umbrella having a plurality of ribs pivotally linked with one another. The present invention may also be used for an automatic umbrella having spring means for automatically extending the ribs and umbrella cloth for immediately opening use.

I claim:

1. A folding frame for use in umbrella or the like comprising:

a central shaft having an upper notch formed on a top portion of the shaft and a lower runner reciprocatively mounted on said shaft and positioned below said upper notch;

a plurality of stretcher ribs each stretcher rib pivotally secured to the lower runner; and a plurality of top ribs for securing an umbrella cloth thereon, each said top rib pivotally secured to said upper notch and to a respective said stretcher rib;

each said stretcher rib having an inner end portion pivotally secured to said lower runner and having an outer end portion pivotally secured to each said top rib;

the improvement which comprises:

each said stretcher rib having a flat portion defining a plane adjacent said top ribs and an arcuate portion curving upwardly from said flat portion towards said upper notch whereby a pivot point is defined for each rib above the plane of said flat portion and positioned to be adjacent to the inner end portion of the stretcher rib, and a stop means provided on said central shaft between said upper notch and lower runner for stopping the movement of said lower runner at a predetermined location whereby said flat rib portion is generally perpendicular to said central shaft but defines an angle of less than ninety degrees between the plane of said flat rib portion and shaft below said stretcher ribs.

2. The umbrella of claim 1 wherein said stop means comprises a limiting sleeve provided between said upper notch means and said lower runner.

* * * * *